US006842691B2

(12) United States Patent
Hagner et al.

(10) Patent No.: US 6,842,691 B2
(45) Date of Patent: Jan. 11, 2005

(54) CAM SYNCHRONIZATION ALGORITHM FOR ENGINE WITH VARIABLE CAM TIMING

(75) Inventors: David G. Hagner, Birmingham, MI (US); Mrdjan J. Jankovic, Birmingham, MI (US); Stephen Lee Cooper, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 79 days.

(21) Appl. No.: 10/063,351

(22) Filed: Apr. 15, 2002

(65) Prior Publication Data

US 2003/0192495 A1 Oct. 16, 2003

(51) Int. Cl.[7] ..... F01L 1/34; F02D 45/00

(52) U.S. Cl. ..... 701/115; 123/90.17

(58) Field of Search ..... 701/101, 102, 701/103, 104, 105, 108, 112, 113, 114, 115; 123/90.11, 90.12, 90.13, 90.15, 90.16, 90.17, 90.18, 490; 251/129.01, 129.09, 129.1, 129.15, 129.16; 91/361, 364

(56) References Cited

U.S. PATENT DOCUMENTS 4,907,493 A * 3/1990 Bellanger et al. ..... 91/361
5,245,968 A 9/1993 Kollas et al.
5,363,817 A * 11/1994 Ikeda et al. ..... 123/90.17
6,219,611 B1 4/2001 Russell
6,425,355 B1 * 7/2002 Van Der Staay ..... 123/90.11
6,647,335 B2 * 11/2003 Jankovic et al. ..... 701/102

FOREIGN PATENT DOCUMENTS

JP 407279724 A * 10/1995 ..... 251/129.15
JP 2000137529 A * 5/2000 ..... 251/129.09

OTHER PUBLICATIONS

U.S. patent application Ser. No. 10/036,045, filed Nov. 9, 2001, Jankovic; Cooper; Magner; System and Method for Controlling Dual Camshafts in a Variable Cam Timing Engine.

* cited by examiner

*Primary Examiner*—Willis R. Wolfe
(74) *Attorney, Agent, or Firm*—Allan J. Lippa

(57) ABSTRACT

A system and method for controlling first and second phase shiftable camshafts in a variable cam timing engine is provided. The method includes determining when the first camshaft is moving toward a first scheduled phase angle with respect to the crankshaft with a larger camshaft angular positioning error than the second camshaft. Finally, the method includes slowing down the first camshaft so that synchronized camshaft positioning can be better achieved.

17 Claims, 4 Drawing Sheets

CAM SYNCHRONIZATION ALGORITHM FOR ENGINE WITH VARIABLE CAM TIMING

BACKGROUND OF THE INVENTION

1. Field of the Invention

The invention relates to a system and method for controlling multiple camshafts in a variable cam timing engine.

2. Background of the Invention

Engines have utilized variable cam timing (VCT) mechanisms to control the opening and closing of intake valves and exhaust valves communicating with engine cylinders. In particular, each VCT mechanism is usually utilized to adjust a position of a camshaft (which actuates either intake valves or exhaust valves or both) with respect to a crankshaft position. By varying the position of the camshaft (i.e., camshaft angle) with respect to the position of the crankshaft, engine fuel economy can be increased and engine emissions can be decreased.

In these engines having VCT mechanisms, the inventors of the present invention have realized that it is desired to shift the position of camshafts in the VCT mechanisms synchronously (i.e., at the same speed) to a desired phase angle with respect to the crankshaft. However, the inventors herein have also recognized that first and second camshafts associated with first and second VCT mechanisms, respectively, in an engine, may not follow the same trajectory, or move at different rates, to the desired phase angle. For example, the first VCT mechanism may be actuated at a lower pressure than a second VCT mechanism due to a clogged oil line communicating with the first VCT, resulting in different movement of the first camshaft. Still further, the first VCT mechanism may "stick" at cold temperatures resulting in different movement of the first camshaft as compared to the second camshaft of the second VCT mechanism. During non-synchronous movement of the first and second camshafts, the air charge delivered to first and second cylinder banks, respectively, may be different. The difference in air charge can result in differing torques being produced by the first and second cylinder banks resulting in undesirable engine shaking and increased engine noise. Further, the difference in air charge may result in non-optimal spark timing in one of the cylinder banks resulting in increased engine knock in the cylinder bank. Still further, the difference in air charge may result in a rich air-fuel mixture being delivered to one of the cylinder banks resulting in decreased fuel economy.

One approach for controlling engines with multiple cam timing actuators attempts to synchronize the cam operation based on determining which actuator has the slowest response. In particular, after the slowest actuator is detected, the other actuators are slaved to the slowest actuator, thereby attempting to keep all the actuators moving at approximately the same speed. Such a method is described in U.S. application Ser. No. 10/036,045, filed Nov. 9, 2001, "System and Method for Controlling Dual Camshafts in a Variable Cam Timing Engine", which has been assigned to the assignee of the present invention.

The inventors herein have recognized a disadvantage with the above approach. In particular, while slowing down faster actuators may result in all actuators moving with approximately the same velocity, this does not necessarily provide synchronized movement. In other words, different cam shafts may be moving at the same velocity, but in different positions. Thus, while the velocities may be synchronized, since cam position affects engine breathing, ignition timing, and various other parameters, this parameter can be more important than cam velocity.

SUMMARY OF INVENTION

The foregoing problems and disadvantages are overcome by a method for operating an internal combustion engine having a first and second valve actuator coupled to a first and second valve of the engine. The method comprises:

- determining a first and second desired value for the first and second actuators;
- measuring a first and second actual value of the first and second actuators;
- calculating a first and second error value based on respective differences between said first and second desired values and said first and second actual values;
- selecting one of said first and second actuators based on said first and second error values; and
- modifying a control signal to said selected actuator.

The inventive system and method for controlling the first and second camshafts solves the problem of engine torque fluctuations during movement of the camshafts. In particular, the inventive system and method slows down the movement of the camshaft with less positioning error so that the first and second camshaft's movement toward a desired phase angle is more synchronized. The more synchronous results in a more equal air charge being provided to first and second cylinder banks during the dual camshaft movement which reduces the engine torque fluctuations.

Another advantage is that the present invention is applicable to multiple independent cam actuators on the same engine bank.

DETAILED DESCRIPTION

An engine may be configured in various ways according to the present invention. For example, the engine may have multiple VCT phaser devices that are expected to move in unison or with certain prescribed relationships. This can occur in Intake Only, Exhaust Only, Dual Equal (intake and exhaust shifted together), and Dual Independent (intake and exhaust shifted independently, possibly through different ranges and directions) VCT systems. Further, the engine may have multiple banks, each with its own VCT systems.

As discussed above, transient VCT shifting is relevant because the VCT position directly affects airflow through the cylinder port. Accurate estimates of air mass and residual gas inducted into the cylinder are used for air/fuel control and to correct spark advance, both of which affect emissions and fuel economy. Characterization of the engine can accommodate transient non-ideal VCT phase position as the actuators attempt to place the cam shafts at the desired operating point, but this problem becomes more difficult to handle if actuators in different banks have positions that differ significantly during transients, thereby resulting in bank imbalances. Additionally, for dual independent (DI) VCT systems, there may be benefits to maintaining the intake-to-exhaust valve "overlap" (timing between intake valve opening and exhaust valve closing) during transients, and this overlap will depend on phaser shifting velocities.

The present invention describes an algorithm for synchronizing the operation of all phasers of a DI-VCT system (two phasers for an "in-line" engine, or four phasers for a "V" engine, as just two specific examples) when engine conditions cause the phasers to move in different ways, or with differing responses. Note that this synchronization is precluded under certain engine operating conditions, where such control action may be more detrimental to driver satisfaction or could cause increases in emissions, for example, than benefits gained in emissions or fuel economy.

Figure 1:
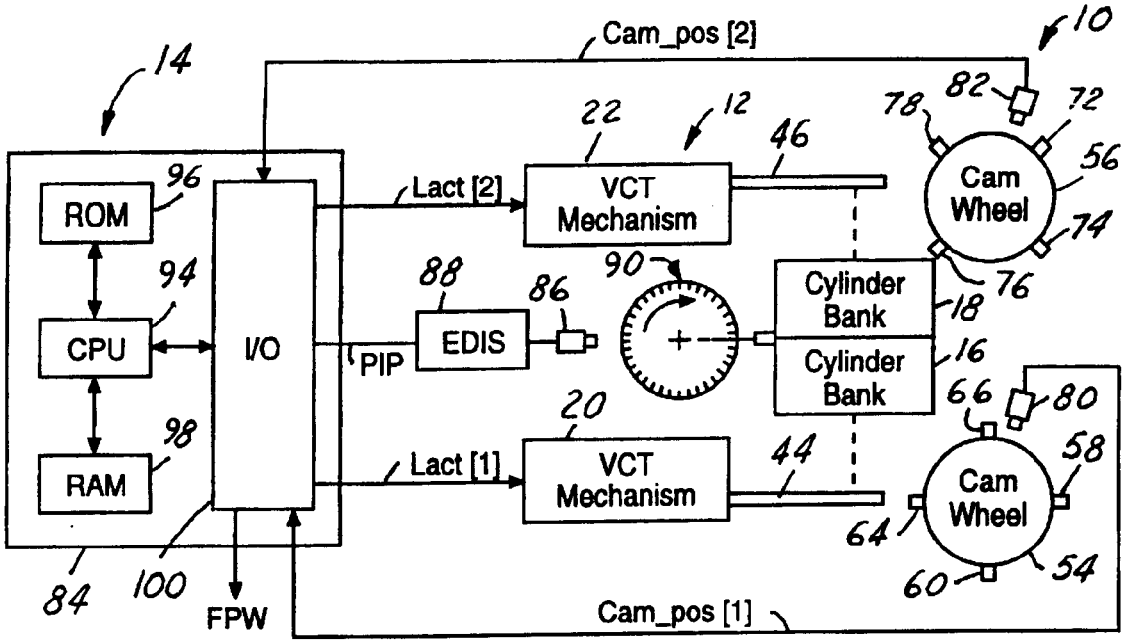
FIG. 1 is block diagram of an automotive vehicle having two VCT mechanisms and a control system for controlling the mechanisms. Note that additional VCT mechanisms can be included as described below.

Referring now to the drawings, like reference numerals are used to identify identical components in the various views. Referring to FIG. 1, an automotive vehicle 10 having an engine 12 and a control system 14 is illustrated.

Figure 2:
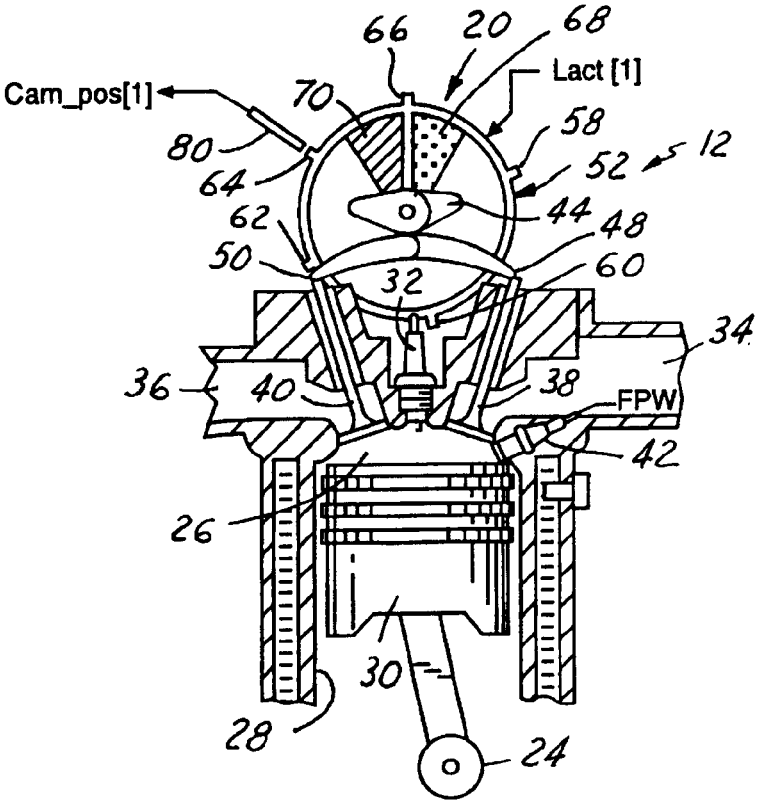
FIG. 2 is a cross-section view of one of the VCT mechanisms shown in FIG. 1.

Engine 12 includes cylinder banks 16, 18 VCT mechanisms 20, 22 and a crankshaft 24. Referring to FIG. 2, each of cylinder banks 16, 18 may have a plurality of cylinders, however, one cylinder of cylinder bank 16 is shown along with VCT mechanism 20 for purposes of simplicity. As illustrated, engine 12 further includes a combustion chamber 26, cylinder walls 28, a piston 30, a spark plug 32, an intake manifold 34, an exhaust manifold 36, an intake valve 38, an exhaust valve 40, and a fuel injector 42.

As used herein, the term "cylinder bank" refers to a related group of cylinders having one or more common characteristics, such as being located proximate one another or having a common emission control device (ECD), intake manifold, and/or exhaust manifold for example. This would include configurations having a group of cylinders on the same side of engine treated as a bank even though these cylinders may not share a common intake or exhaust manifold (i.e., the exhaust manifold could be configured with separate exhaust runners or branches if desired or beneficial). Similarly, cylinder banks can also be defined for in-line cylinder configurations which are within the scope of this invention.

Referring to FIGS. 1 and 2, VCT mechanisms 20, 22 are provided to actuate intake/exhaust valves in cylinder banks 16, 18. For example, as shown in FIG. 2, VCT mechanism 20 is utilized to actuate intake valve 38 and exhaust valve 40 of a cylinder associated with cylinder bank 16 to control air flow entering the cylinder and exhaust gases exiting the cylinder, respectively. VCT mechanism 20 cooperates with a camshaft 44, which is shown communicating with rocker arms 48, 50 for variably actuating valves 38, 40. Camshaft 44 is directly coupled to housing 52. Housing 52 forms a toothed cam wheel 54 having teeth 58, 60, 62, 64, 66. Housing 52 is hydraulically coupled to an inner shaft (not shown), which is in turn directly linked to crankshaft 24 via a timing chain (not shown). Therefore, housing 52 and camshaft 44 rotate at a speed substantially equivalent to the inner camshaft. The inner camshaft rotates at a constant speed ratio to crankshaft 24. However, by manipulation of the hydraulic coupling which will be described later herein, the relative position of camshaft 44 to crankshaft 24 can be varied by hydraulic pressure in advance chamber 68 and retard chamber 70. By allowing high-pressure hydraulic fluid to enter advance chamber 68, the relative relationship between camshaft 44 and crankshaft 24 is advanced. Thus, intake valve 38 and exhaust valve 40 open and close at a time earlier than normal relative to crankshaft 24. Similarly, by allowing high-pressure hydraulic fluid to enter retard chamber 70, the relative relationship between camshaft 44 and crankshaft 24 is retarded. Thus, intake valve 38 and exhaust valve 40 open and close at a time later than normal relative to crankshaft 24.

VCT mechanism 22 may include like components as illustrated for VCT mechanism 20 and may be hydraulically actuated as discussed above with reference to mechanism 20. In particular, VCT mechanism 22 includes cam wheel 56 and teeth 72, 74, 76, 78 disposed around the outer surface of the housing of mechanism 22.

Teeth 58, 60, 64, 66 of cam wheel 54 are coupled to housing 52 and camshaft 44 and allow for measurement of relative position of camshaft 44 via cam timing sensor 80 which provides signal CAM_POS[1] to controller 84. Tooth 62 is used for cylinder identification. As illustrated, teeth 58, 60, 64, 66 may be evenly spaced around the perimeter of cam wheel 54.

Similarly, teeth 72, 74, 76, 78 of cam wheel 56 are coupled to cam wheel 56 and camshaft 46 and allow for measurement of relative position of camshaft 46 via cam timing sensor 82 which provides signal CAM_POS[2] to controller 84. Teeth 72, 74, 76, 78 of cam wheel 56 may also be equally spaced around the perimeter of wheel 56 for measurement of camshaft timing.

Referring to FIGS. 1 and 2, controller 84 sends control signal LACT[1] to a solenoid spool valve (not shown) to control the flow of hydraulic fluid either into advance chamber 68, retard chamber 70, or neither of VCT mechanism 20. Similarly, controller 84 sends a control signal LACT[2] to another spool valve (not shown) to control VCT mechanism 22.

Relative position of camshaft 44 is measured in general terms, using the time, or rotation angle between the rising edge of a PIP signal (explained in greater detail below) and receiving a signal from one of the teeth 58, 60, 64, 66. Similarly, the position of camshaft 46 is measured using the time, or rotation angle between the rising edge of the PIP signal and receiving a signal from one of the teeth 72, 74, 76, 78. In an alternative embodiment, a fixed crankshaft point can be used instead of the rising PIP edge.

For the particular example of a V-8 engine, with two cylinder banks and a five-toothed cam wheel 54, a measured of cam timing for a camshaft 44 is received four times per cam revolution, with the extra signal used for cylinder identification. A detailed description of the method for determining relative position of the camshafts 44, 46 is described in commonly assigned U.S. Pat. No. 5,245,968 which is incorporated by reference herein in its entirety.

Referring again to FIG. 2, combustion chamber 26 communicates with intake manifold 34 and exhaust manifold 36 via respective intake and exhaust valves 38, 40. Piston 30 is positioned within combustion chamber 26 between cylinder walls 28 and is connected to crankshaft 24. Ignition of an air-fuel mixture within combustion chamber 26 is controlled via spark plug 32 which delivers ignition spark responsive to a signal from a distributor less ignition system (not shown).

Intake manifold 34 is also shown having fuel injector 42 coupled thereto for delivering fuel in proportion to the pulse width of signals (FPW) from controller 84. Fuel is delivered to fuel injector 42 by a conventional fuel system (not shown) including a fuel tank, fuel pump, and fuel rail (now shown).

Although port fuel injection is shown, direct fuel injection could be utilized instead of port fuel injection. Referring to FIG. 1, control system 14 is provided to control the operation of engine 12 and to implement a method for controlling VCT mechanisms 20, 22 in accordance with the present invention. Control system 14 includes camshaft position sensors 80, 82, crankshaft position sensor 86, ignition system controller 88, and engine controller 84.

Camshaft position sensors 80, 82 are provided to generate signals indicative of a position of camshafts 44, 46, respectively. Sensors 80, 82 are conventional in the art and may comprise hall-effect sensors, optical encoders, or variable reluctance sensors. As cam wheel 54 rotates, teeth 58, 60, 64, 66 equally spaced at ninety degrees (when engine 12 is a V8 engine for example) around the wheel 54 pass by sensor 80. The sensor 80 senses the passing of each tooth and generates respective electric cam pulses or position signals CAM_POS[1] which are received by controller 84. Similarly, as cam wheel 56 rotates, teeth 72, 74, 76, 78 pass by sensor 82 which generates respective electric cam pulses or position signals CAM_POS[2] which are received by controller 84.

The crankshaft position sensor 86 is provided to generate a signal indicative of a position of crankshaft 24. Sensor 86 is conventional in the art and may comprise a hall effect sensor, an optical sensor, or a variable reluctance sensor. A camshaft sprocket 90 is fixed to crankshaft 24 and therefore rotates with crankshaft 24. Sprocket 90 may include thirty-five gear teeth 92 spaced ten degrees apart which results in one tooth missing that sensor 86 uses for sensing the position of sprocket 90. The sensor 86 generates position signal CS_POS that is transmitted to ignition system controller 88. Controller 88 converts the signal CS_POS into the PIP signal which is then transmitted to engine controller 84. A PIP pulse occurs at evenly spaced rotational intervals of crankshaft 24 with one pulse per cylinder per engine cylinder cycle. This series of pulses comprise the PIP signal.

The engine controller 84 is provided to implement the method for controlling VCT mechanisms 20, 22 and in particular, for controlling the position of camshafts 44, 46. Further, controller 84 is provided to compare signal CAM_POS[1] to signal PIP to determine a relative position (i.e., phase angle) of camshaft 44 with respect to crankshaft 24. Similarly, controller 84 compares signal CAM_POS[2] to signal PIP to determine a relative position of camshaft 46 with respect to crankshaft 24. As illustrated, controller 84 includes a CPU 94 and a computer readable storage media comprising nonvolatile and volatile storage in a read-only memory (ROM) 96 and a random-access memory (RAM) 98. The computer readable media may be implemented using any of a number of known memory devices such as PROMs, EPROMs, EEPROMs, flash memory or any other electric, magnetic, optical or combination memory device capable of storing data, some of which represent executable instructions, used by microprocessor 94 in controlling engine 12. Microprocessor 94 communicates with various sensors and actuators (discussed above) via an input/output (I/O) interface 100. Of course, the present invention could utilize more than one physical controller to provide engine/vehicle control depending upon the particular application.

Figure 3A:
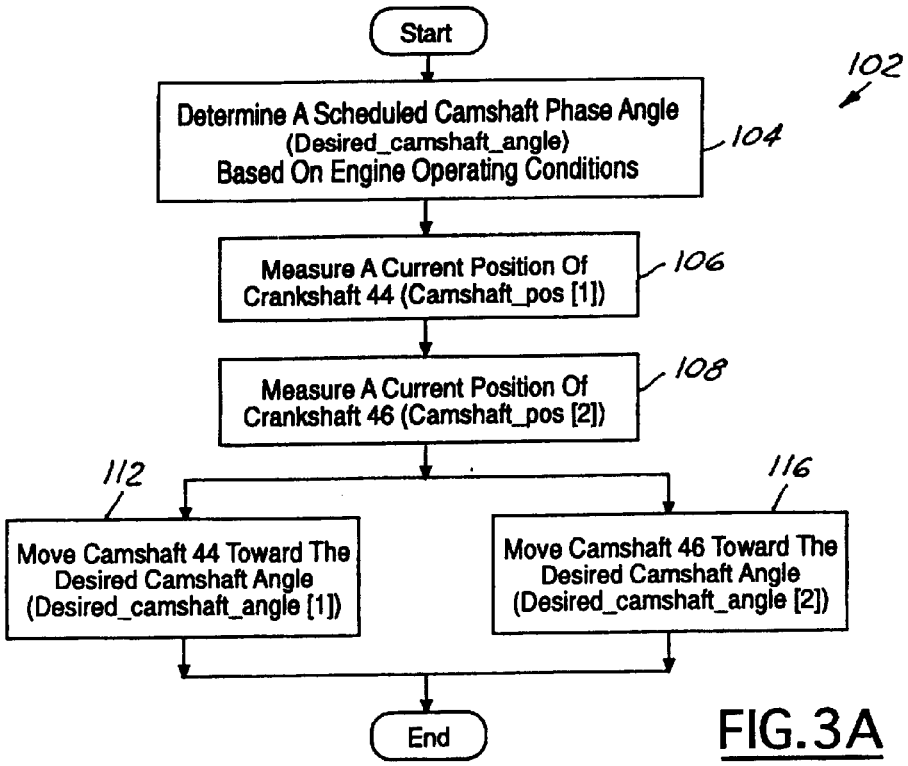
FIGS. 3A–3B are flowcharts of a method of controlling camshafts of VCT mechanisms in an engine in accordance with the present invention.

Referring to FIG. 3A, a method 102 for controlling camshafts 44, 46 in accordance with the present invention will be explained. As illustrated, a step 104 determines a scheduled/desired camshaft phase angle (Desired_camshaft_angle) based on engine operating parameters. Those skilled in the art will recognize that the desired camshaft phase angle for camshafts 44, 46 can be determined based on various engine operating parameters. For example, when engine 12 has a mechanically controlled throttle (not shown) controlling air flow into intake manifold 34, controller 84 may utilize a throttle position, engine speed, barometric pressure, air charge temperature, and coolant temperature to determine a scheduled camshaft phase angle from a lookup table. Alternately, for example, when engine 12 has an electronically controlled throttle (not shown) controlling air flow into manifold 34, controller 84 may use an accelerator pedal position and a vehicle speed to determine the schedule camshaft phase angle from a lookup table. Further, different desired cam positions can be determined for intake and exhaust timing if both have independent actuators to allow independent movement. As such, for example, in a V-8 engine with dual independent cam timing, four desired cam positions can be scheduled based on operating conditions.

Next at step 106, controller 84 determines the current position (Camshaft_pos[1]) of camshaft 44, based on the signal CAM_POS[1] and the signal PIP.

Similarly, at step 108, controller 84 determines the current position (Camshaft_pos[2]) of camshaft 46 based on the signal CAM_POS[2] and the signal PIP. Similarly, if there are additional variable camshafts, the routine determines a position for these additional actuators. As such, Camshaft_pos[i] is determined, where i is the number of camshafts that are being controlled, or synchronized.

Next, controller 84 simultaneously executes step 112 for controlling camshaft 44 and step 116 for controlling camshaft 46.

Figure 3B:
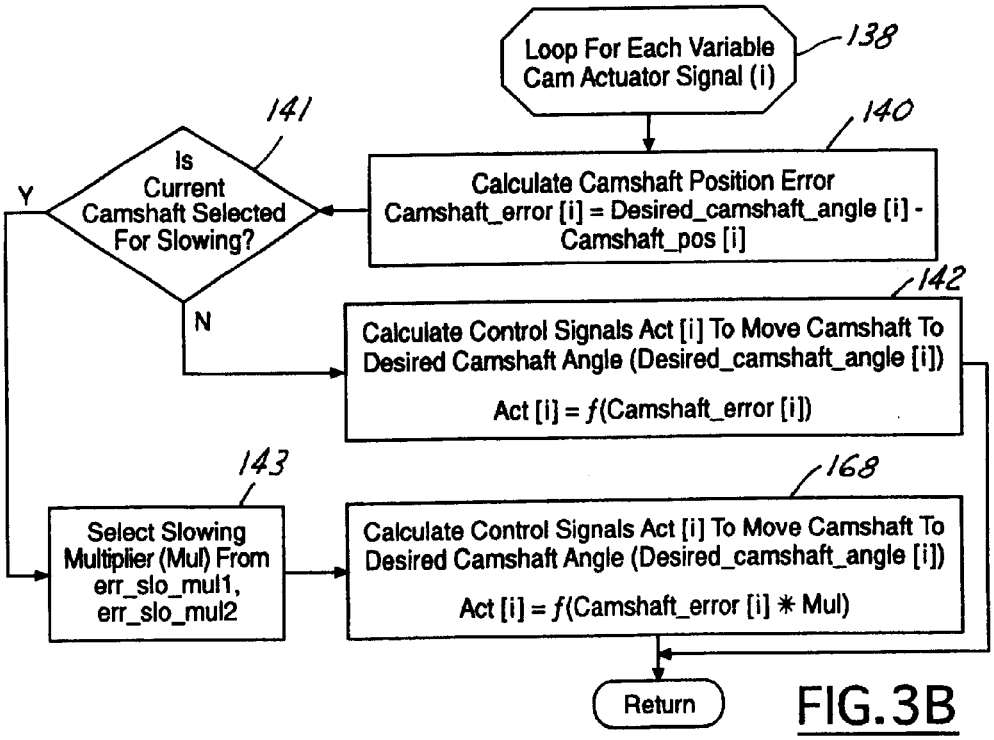

Referring to FIG. 3A, at step 112, the camshaft 44 is moved to a position represented by the value Desired_camshaft_angle[1]. Referring to FIG. 3B, the underlying method for implementing steps 112 and 116 will now be discussed. At step 138, the routine loops for each camshaft (i). At step 140, a camshaft position error is calculated using the following equation:

$$\text{Camshaft_error}[i]=\text{Desired_camshaft_angle}[i]-\text{Camshaft_}pos[i]]$$

Then, at step 141, the routine determines whether the current camshaft (i) has been selected for slowing. If not, at step 142, control signal ACT[i] is calculated to move camshaft 44 to Desired_camshaft_angle[i]. In particular, the signal ACT[1] is calculated as a function of the camshaft position error using the following equation:ACT[1]=f(Camshaft_error[i]). For example, a PID (proportional, integral, derivative) controller can be used. Then, signal ACT is sent to either LACT, or RACT, depending on which actuator is to be moved. After step 142, the method 138 is ended.

Otherwise, if the answer to 141 is YES, the routine (in step 143) selects a slowing multiplier (MUL), if the err_slo_mul_(1 or 2) had been previously selected, from either err_slo_mul1, or err_slo_mul2. Note, multipliers are usually less than 1.

Then, at step 168, control signal ACT[i] is calculated to move the selected camshaft to Desired_camshaft_angle[i] with the adjusted control action to slow the movement. In particular, the signal ACT[i] is calculated as a function of the camshaft position error using the following equation:ACT[i]=f(Camshaft_error[2]*MUL). After step 168, the method 102 is ended.

Referring again to FIG. 3A, step 116 is utilized for controlling the position of camshaft 46. Similarly, additional steps can be added for additional actuators, for example if the engine is a V-8 with dual independent camshaft control.

Referring to FIG. 3A, at step 116, the camshaft 46 is moved to a position represented by the value Desired_camshaft_angle[2], as described in FIG. 3B. Note that FIG. 3B is again performed for camshaft 46 (see step 138).

Figure 4A:
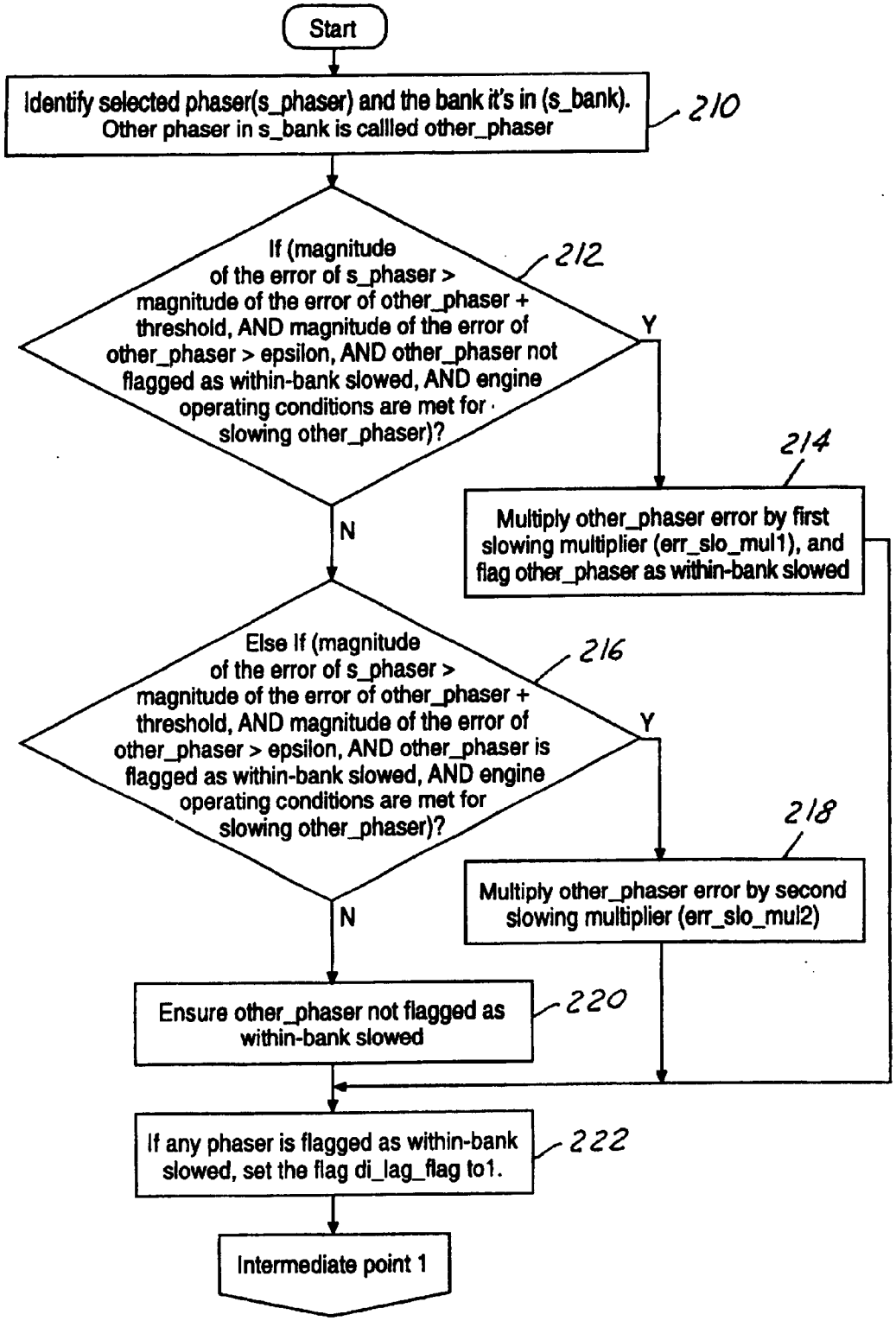
FIG. 4 is a flowchart of a method of controlling camshafts of VCT mechanisms in an engine in accordance with the present invention.
Figure 4B:
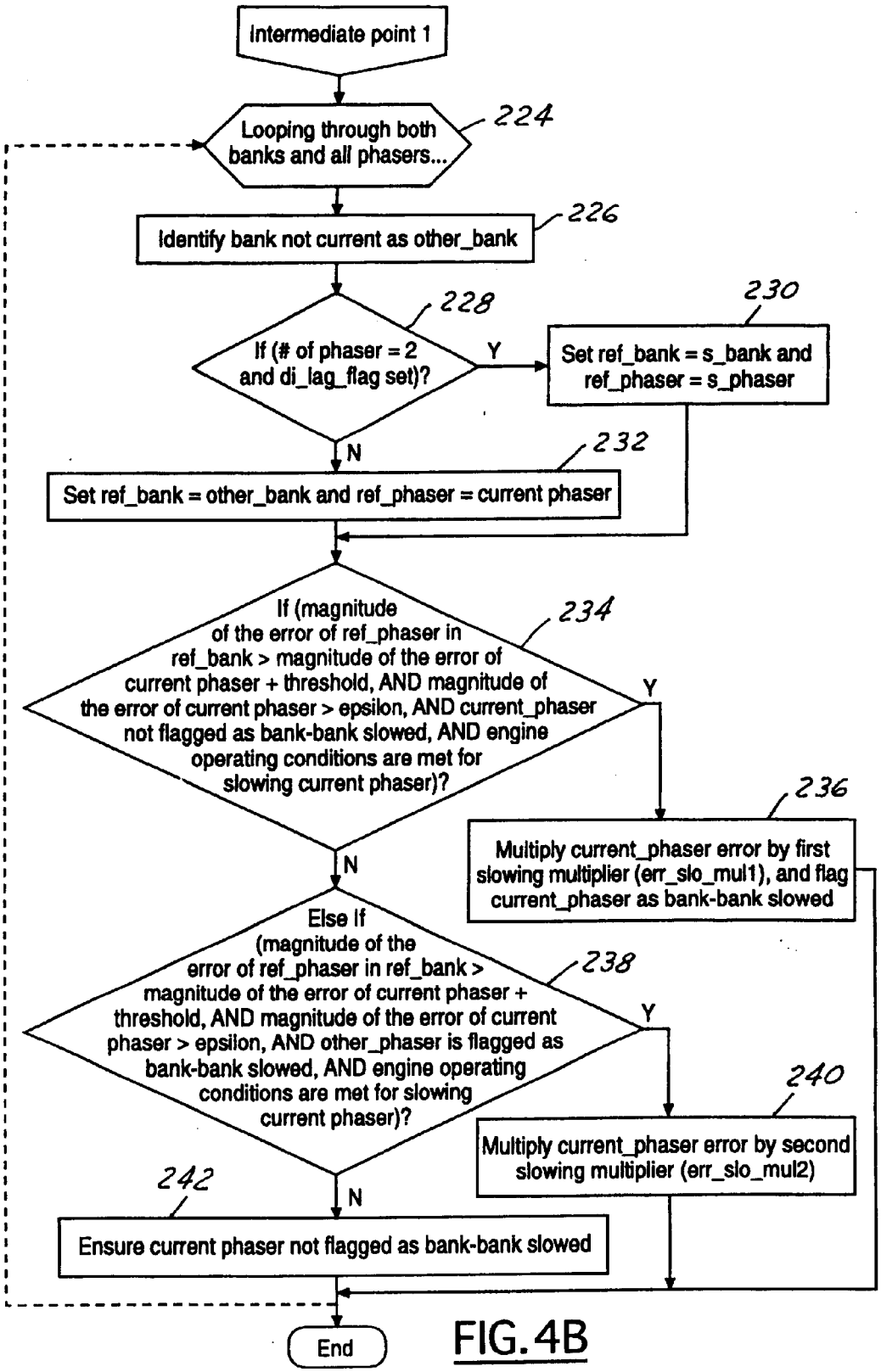

Referring now to FIG. 4, more details of the routine described for synchronizing the operation of all phasers of a multi-phaser variable cam timing system when engine operating conditions caused the phasers to move at different angular velocities. The routine is applicable to various engine types, including inline engines and V-engines. In other words, if an inline engine is used with two phasers (one for intake cam timing and one for exhaust cam timing) or if a V-engine is used (two exhaust phasers and two intake phasers) the routine can be simply adjusted to take this into account.

Further, if a V-engine is used with only one phaser on each bank, the routine can also accommodate such a situation.

In general terms, the routine of FIG. 4 first performs synchronization between actuators within a bank of cylinders. This is done by selecting the cam actuator with the largest error between the desired and actual values. Then, if operating conditions permit, the other of the actuators is slowed down to synchronize its error (rather than simply velocity) with the actuator having the greater error. As such, cam shaft positioning synchronization can be achieved.

The routine also provides for bank-to-bank synchronization of cam actuators on different engine banks. Once the routine determines the actuator with the greatest (absolute) error between desired and actual cam shaft position values, the other actuators on the other bank are slowed to provide synchronization. In this way, for example, a V-engine having two banks and a total of four shaft actuators can operate with improved emissions and fuel economy performance by synchronizing all four cam shaft actuators.

Note that operation according to the present invention, and particularly with regard to the routine of FIGS. 3–4, may slow down an actuator that is moving with the slowest velocity. However, this can provide improved performance by considering the following situation. In particular, consider a first actuator with a very large error between desired and actual values, and a second actuator with a very small difference between desired and actual values. Even though the second actuator may be moving much slower than the first actuator, it can still be preferable to slow down the second actuator, since slowing the first results in an even longer delay before both reach the desired values. As such, the present invention recognizes that synchronization of error can be more effective (under some conditions) than synchronization of speed.

Referring now specifically to FIG. 4, in step 210, the routine selects a phaser (s_phaser), out of all the phasers identified, as the one with the largest error (commanded—actual position), and the bank with this selected phaser is identified as the selected bank (s_bank).

The routine then performs "within-bank" synchronization in the s_bank. In step 212, If the error of the s_phaser is greater than the error of the other phaser in the s_bank plus a threshold (ph_dif_thr), the absolute error of the other phaser is greater than an epsilon (ph_err_eps), the other phaser is not already flagged for within-bank slowing, and engine operating conditions are met for the other phaser to be slowed, then, in step 214, the routine multiplies the error of the other phaser by a first slowing multiplier (err_slo_mul1), and uses the resulting value in place of the error in the phaser's PID control loop, and flags that phaser as being within-bank slowed. In step 212, the engine operating conditions where slowing is not allowed can be, for example, if the driver is performing a tip-in of the pedal, it would be undesirable to slow down an intake valve phaser that is advancing. Other operating conditions can be used to determine when to allow slowing, in addition to those described above, such as, for example, engine coolant temperature, vehicle speed, gear ratio, etc.

Continuing with FIG. 4, if the answer to step 212 is no, the routine determines in step 216 if the error of the s_phaser is greater than the error of the other phaser in the s_bank plus a threshold (ph_dif_thr), the absolute error of the other phaser is greater than an epsilon (ph_err_eps), the other phaser is already flagged for within-bank slowing, and engine operating conditions are met for the other phaser to be slowed. If so, in step 218 the routine multiplies the error of the other phaser by a second slowing multiplier (err_slo_mul2) and uses the resulting value in place of the error in the phaser's PID control loop.

Otherwise, the routine ensures the other phaser is not flagged for within-bank slowing in step 220. In step 222, the routine determines if any phaser is flagged for within-bank slowing, and if so, sets the flag di_lag_flg to 1. The above use of the within-bank slowing flag provides immunity to noise in the position signals, the time difference between position updates and hence changes to the error calculations due to angular offsets between teeth on the cam pulse wheels.

Then, the routine performs the following steps in both banks and for all phasers (step 224).

In step 226, the routine identifies other-bank as the one not current. In general terms, steps 228, 230, and 232 keep track of whether there has been within bank slowing. Then, when in bank-bank slowing, the reference phaser is the slow phaser identified in within bank slowing. Otherwise, like phasers are synchronized.

Then, in step 234, if the error of the s_phaser is greater than the error of the current phaser plus a threshold (bnk_dif_thr), the absolute error of the current phaser is greater than an epsilon (bnk_err_eps), the current phaser is not already flagged for bank-bank slowing, and engine operating conditions are met for the current phaser to be slowed, then in step 236, the routine multiplies the error of the other phaser by a first slowing multiplier (err_slo_mul1), and uses the resulting value in place of the error in the phaser's PID control loop, and flag that phaser as being bank-bank slowed.

Otherwise, in step 238, if the error of the s_phaser is greater than the error of the current phaser plus a threshold (bnk_dif_thr), the absolute error of the current phaser is greater than an epsilon (bnk_err_eps), the current phaser is already flagged for within-bank slowing, and engine operating conditions are met for the current phaser to be slowed, then in step 240, the routine multiplies the error of the current phaser by a second slowing multiplier (err_slo_mul2) and uses the resulting value in place of the error in the phaser's PID control loop.

Otherwise, in step 242, the routine ensures the current phaser is not flagged for bank-bank slowing. The above use of the bank-bank slowing flag provides immunity to noise in the position signals, the time difference between position updates and hence changes to the error calculations due to angular offsets between teeth on the cam pulse wheels.

The control system 14 and method 102 for controlling camshafts 44, 46 of VCT mechanisms 20, 22, respectively, provide a substantial advantage over conventional systems and methods. In particular, the system 14 and method 102 slows down the movement of the camshaft with greater positioning error so that the camshafts 44, 46 are error-synchronized to a desired phase angle. The synchronous movement results in more equal air charge being provided to first and second cylinder banks during the camshaft movement, while providing more equal positioning, which reduces engine torque fluctuations, engine noise, and emissions.

What is claimed is:

1. A method for operating an internal combustion engine having a first and second valve actuator coupled to a first and second valve of the engine, the method comprising:

determining a first and second desired value for the first and second actuators;

measuring a first and second actual value of the first and second actuators;

calculating a first and second error value based on respective differences between said first and second desired values and said first and second actual values;

selecting one of said first and second actuators based on first and second air values; and modifying a control signal to said selected actuator.

2. The method recited in claim 1 wherein said first and second desired values are based on engine operating conditions.

3. The method recited in claim 1 wherein said first and second valve actuators comprise variable cam timing actuators.

4. The method recited in claim 1 wherein said first and second valve actuators comprise variable intake cam timing actuators.

5. The method recited in claim 1 wherein said first and second valve actuators comprise variable exhaust cam timing actuators.

6. The method recited in claim 1 wherein said selecting further comprises determining which of said first and second actuators has a greater error value, and selecting the actuator with said greater error value.

7. The method recited in claim 6 wherein said greater error value is a greater absolute error value.

8. The method recited in claim 7 wherein said modifying comprises reducing said calculated error for said selected actuator.

9. The method recited in claim 8 wherein said control signal is based on a gain and said calculated error for said selected actuator.

10. A method for controlling an engine having a first and second valve actuator for adjusting valve operation of cylinders of the engine, the method comprising:

determining a first and second desired value for the first and second actuators;

measuring a first and second actual value of the first and second actuators;

calculating a first and second error value based on respective differences between said first and second desired values and said first and second actual values;

selecting one of said first and second actuators based on first and second air values; and indicating whether engine operating conditions allow slowing of one of first and second valve actuators; and in response to said indication, adjusting a control signal to said selected actuator to slow said actuator.

11. The method recited in claim 10 wherein said first and second desired values are based on engine operating conditions.

12. The method recited in claim 10 wherein said first and second valve actuators comprise variable cam timing actuators.

13. The method recited in claim 10 wherein said selecting further comprises determining which of said first and second actuators has a greater error value, and selecting the actuator with said greater error value.

14. The method recited in claim 13 wherein said greater error value is a greater absolute error value.

15. The method recited in claim 14 wherein said control signal is based on a gain and said calculated error for said selected actuator.

16. An article of manufacture comprising:

a computer storage medium having a computer program encoded therein for controlling an engine having a first and second valve actuator for adjusting valve operation of cylinders of the engine, said computer storage medium comprising:

code for determining a first and second desired value for the first and second actuators;

code for measuring a first and second actual value of the first and second actuators;

code for calculating a first and second error value based on respective differences between said first and second desired values and said first and second actual values;

code for selecting one of said first and second actuators based on first and second error values; and code for indicating whether engine operating conditions allow slowing of one of said first and second valve actuators; and code for adjusting a control signal to said selected actuator to slow said actuator in response to said indication.

17. The article recited in claim 16 wherein said conditions allowing slowing of one of said first and second valve actuators include at least one of: cam movement direction, cam position, cam movement speed, pedal position, engine temperature, or ambient temperature.

* * * * *

UNITED STATES PATENT AND TRADEMARK OFFICE

CERTIFICATE OF CORRECTION

PATENT NO. : 6,842,691 B2 
DATED : January 11, 2005
INVENTOR(S) : David G. Hagner, Mrdjan J. Jankovic and Stephen Lee Cooper It is certified that error appears in the above-identified patent and that said Letters Patent is hereby corrected as shown below:

Column 9,
Line 20, delete "air" and insert -- error -- therefor.

Signed and Sealed this

Twenty-ninth Day of November, 2005

JON W. DUDAS
*Director of the United States Patent and Trademark Office*